US006217379B1

(12) United States Patent
D'Hulster et al.

(10) Patent No.: US 6,217,379 B1
(45) Date of Patent: Apr. 17, 2001

(54) PLUG-IN CONTACT

(75) Inventors: Freddy D'Hulster, Aartrijke (BE); Hans-Jost Heimüller, Dudenhofen (DE); Dimitri Meulemeester, Torhout; Frans Van Deynse, Maldegem, both of (BE)

(73) Assignee: TYCO Electronics Logistics AG, Steinach (CH)

( * ) Notice: Subject to any disclaimer, the term of this patent is extended or adjusted under 35 U.S.C. 154(b) by 0 days.

(21) Appl. No.: 09/508,474

(22) PCT Filed: Jul. 29, 1998

(86) PCT No.: PCT/DE98/02150

§ 371 Date: Jun. 12, 2000

§ 102(e) Date: Jun. 12, 2000

(87) PCT Pub. No.: WO99/13533

PCT Pub. Date: Mar. 18, 1999

(30) Foreign Application Priority Data

Sep. 9, 1997 (DE) ..... 197 39 501

(51) Int. Cl.[7] ..... H01R 13/73
(52) U.S. Cl. ..... 439/572.5; 439/595; 439/877
(58) Field of Search ..... 439/595, 752.5, 439/877, 889, 878, 879

(56) References Cited

U.S. PATENT DOCUMENTS

| | | | | |
|---|---|---|---|---|
| 4,846,739 | * | 7/1989 | Mawby | 439/877 |
| 4,992,064 | * | 2/1991 | Steinhardt et al. | 439/845 |
| 5,207,603 | * | 5/1993 | Peloza | 439/884 |
| 5,254,021 | * | 10/1993 | Yamamoto et al. | 439/866 |
| 5,651,704 | * | 7/1997 | Fukushima et al. | 439/752 |
| 5,795,197 | * | 8/1998 | Tsuji et al. | 439/877 |
| 5,823,834 | * | 10/1998 | Straeb et al. | 439/884 |
| 5,989,079 | * | 6/2000 | Seko et al. | 439/866 |
| 5,989,080 | * | 11/1999 | Tsuji et al. | 439/884 |
| 6,077,131 | * | 6/2000 | Fukuda et al. | 439/884 |

* cited by examiner

*Primary Examiner*—Gary F. Paumen
*Assistant Examiner*—Alexander Gilman
(74) *Attorney, Agent, or Firm*—Herbert L. Lerner; Laurence A. Grenberg; Werner H. Stemer

(57) ABSTRACT

The invention relates to a plug-in contact (10) configured as a single-piece and made from a metal strip, comprising a pin-shaped contact part (12) and a connecting part (16) for connecting an electric line (18). A guide part (14) is arranged between the contact part (12) and the connecting part (16). The guide part (14) is configured in the shape of a box with a triangular cross-section and a flat side of said guide part (14) is arranged at a distance parallel to the original level of the metal strip.

19 Claims, 2 Drawing Sheets

PLUG-IN CONTACT

BACKGROUND Of THE INVENTION

1. Field of the Invention

The invention relates to a plug-in contact produced as a single piece from a metal strip, comprising a pin-shaped contact part and a connecting part for connecting an electric line.

2. Description of the Related Art

Plug-in contacts with a crimped terminal for the line to be connected are generally known. Pin-shaped plug-in contacts, i.e. plug-in contacts with a pin- or needle-shaped contact part are also known. The connecting line is increasingly also being connected by a crimp connection.

In particular, the pin-shaped plug-in contacts with small pin cross-sections of, for example, about 0.4 $mm^2$ were formerly usually produced from step-milled strip or in two parts from a solid pin and a connecting part for the electric line connected thereto, produced from sheet metal. This mode of production involves considerable expenditure in terms of time and/or material, but this is considered to be justified in view of the security of plugging and the flexural strength required. Owing to the possibility, normally required, for installation in plug housings, known plug-in contacts also have to be provided with additional catch marks and other fixing aids so that they maintain their position permanently once installed.

Starting form this state of the art it is an object of the present invention to provide a plug-in contact of the type mentioned at the outset which is easier to produce with equal reliability of operation.

SUMMARY OF THE INVENTION

According to the invention, this object is achieved by the characterising features of claim 1.

The sub-claims relate to further advantageous configurations and developments of the invention.

It is accordingly proposed according to he invention that a guide part is arranged between the contact part and the connecting part, in that the guide part is configured in the shape of a box with a triangular cross-section and in that a flat side of the guide part is arranged at a distance parallel to the original lane of the strip.

A defined orientation of the plug-in contact in the case of the proposed installation in a plug housing can be achieved with the proposed triangular geometry of the guide part.

According to an expedient configuration of the plug-in contact produced form flat material, the guide part is formed by two lugs which are each angled at a first angle along the centre line of the original metal strip, which lugs are bent symmetrically to one another at a second angle so that their longitudinal edges abut and form a covering face.

The plane covering face opposes the original strip plane of the sheet metal strip used for this purpose and extends parallel thereto. This pronounced shaping of the guide part gives the plug-in contact high rigidity owing to work-hardening, so that the necessary material cross-section can be kept small for reasons of strength.

In a preferred configuration of the plug-in contact, the first angle is between 60° and 120°, preferably 120°, and the second angle is 30° to 60°, preferably 30°, in each case.

In a further improvement of the invention, the plug-in contact is characterised in that the guide part comprises, on the connection side, two lug-shaped projections which serve as a stop. These lug-shaped projections act as a stop for the plug-in contact as it is inserted into the above-mentioned plug-housing so that it is fixed in position therein.

To assist this effect, the lug-shaped projections can advantageously be offset form the box part of the guide part.

According to a configuration of the invention, the pin-shaped contact part is formed by two partial lugs which are roughly identical in cross-section, which are bent symmetrically round 180° along the longitudinal axis and, resting tightly against one another, form a closed cross-section. A tip is worked at the leading end of the contact part. The plug-in contact has a common bending line which extends from the tip to the connecting part, so that bending is considerably simplified in comparison with other plug-in contacts.

In a further configuration of the invention, the box part located between the contact part and the connecting part comprises a one-sided recess opposite the original plane of the strip.

This recess is arranged about half way along the guide part. The end faces of the recess can also preferably be limited at least on the connecting side by first tongues which are angled downwardly from the lugs, forming the covering face, of the box parts remaining.

In a development of the invention, the end face of the box part facing the pin-shaped contact part can likewise be limited by two second tongues of identical cross-section at the transition to the contact part, the first and second tongues being configured in the manner of rails or shovels and serving similarly to a shoe horn as an entry aid during insertion and interlocking of the plug-in contact into a plug housing.

To fix the plug-in contact according to the invention more securely in the plug housing, the front edge, facing the recess in the guide part, of the leading contact part adjacent to the contact part is provided as a stop edge for interlocking with a plug housing into which the plug-in contact is inserted. It is held non-positively and positively therein.

The plug housing provided for the plug-in contact according to the invention is characterised, in particular, that is receives at least one plug-in contact, but preferably a plurality of plug-in contacts and in that each proposed plug-in position comprises a catch projection which interacts with the associated plug-in contact. This plug housing is preferably configured as a so-called pin connector housing with plug-in positions arranged side by side for plug-in contacts.

This and further advantageous configurations and improvements of the invention will be illustrated and described in more detail with reference to the embodiments illustrated in the schematic drawings in which:

DESCRIPTION OF THE PREFERRED EMBODIMENT

Figure 1:
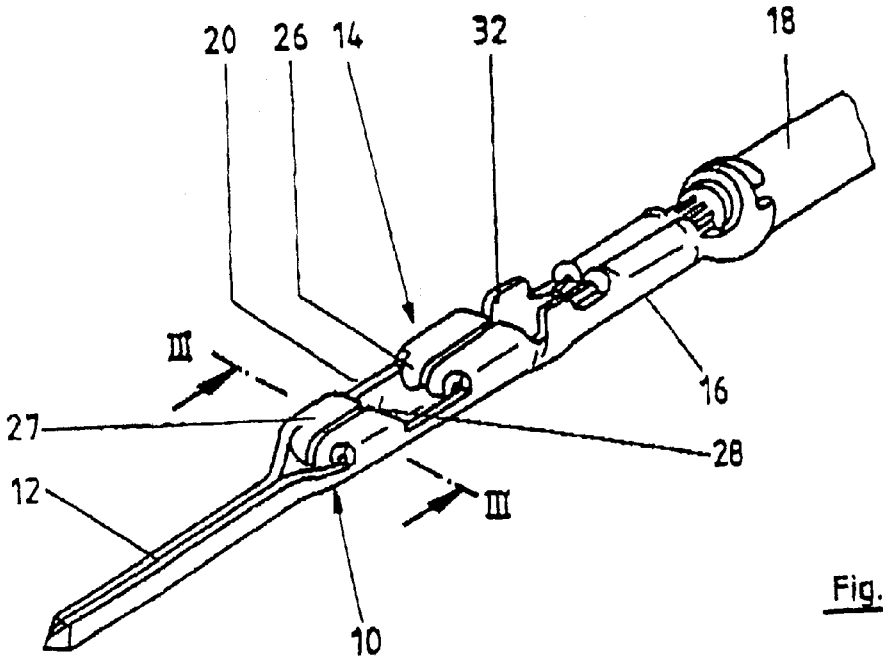
FIG. 1 is a perspective view of a plug-in contact according to the invention.

FIG. 1 shows a plug-in contact 10 according to the invention in an oblique view from above so that its essential features can be seen.

Figure 3:
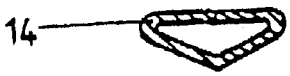
FIG. 3 is across-section through the contact piece along section line III—III.

At its front, the slim plug-in contact 10 possesses a pin-shaped contact part 12 which is connected to a centrally arranged guide part 14 having a triangular cross-section which can be seen in the sectional view in FIG. 3. A connecting part 16 which is configured in a known manner as a crimp connection and is connected to a conductor 18 in the example illustrated is attached to the guide part 14.

According to the invention, the plug-in contact 10 is produced in one piece as a stamped and bent part from a metal strip, the width of the metal strip being determined by the material requirement or the guide part 14. About half way along, this guide part 14 possesses a recess 20 which extends about half way up, is about one third of the length of the guide part 14 and divides the box-shaped guide part 14 into a leading and trailing guide box 14.1, 14.2.

Figure 2:
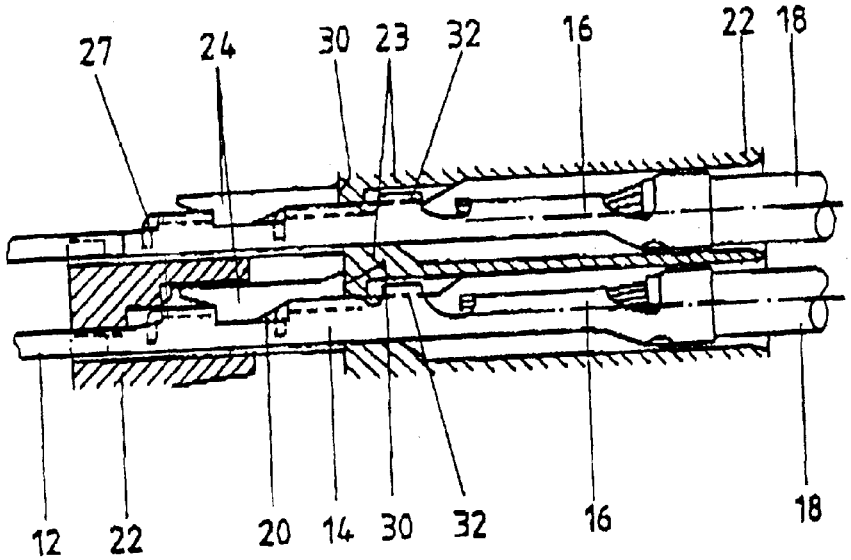
FIG. 2 is a segmentary longitudinal section through a plug housing, intended to receive plug-in contacts, with two plug-in contacts inserted therein.

An elastic catch projection 24 shaped on the associated plug housing 22 shown in FIG. 2 in the manner of a leaf spring on a housing web 23 engages positively in this recess and is thus fixed securely therein so that the plug-in contact 10 is fixed in its position.

To assist this positive engagement during assembly, the recess 20 is covered by angled first and second tongues 26, 27 at the rear end facing the connecting part 16 similarly to the guide part 14 at the transition to the contact part 12, the second tongues additionally also acting as an axial stop. The opposing limiting edge of the recess 20 serves as a stop edge 28 for the catch projection 24.

The housing web 23 on which the resilient catch projection 24 is shaped possesses a catch edge 30 which is at an angle to the plug-in contact and interacts with stop lugs 32 shaped for this purpose on the plug-in contact 10 in the transition region of the guide part 14 to the connecting part 26.

All three portions, in other words the contact part 12, the guide part 14 and the connecting part 16 of the plug-in contact 10 according to the invention have the common feature that they are bent upwards from the original plane of the strip.

The front, in other words the pointed contact part 12 located on the contacting side is produced from a portion of the metal strip which is narrower than the guide part 14, similarly to a part of the connecting part 16, whereas the guide part has the greatest width in the developed view.

The pin-shaped contact tip 12 is bent symmetrically upwardly round 180° along the centre line from two lugs of equal width, so that the two lugs rest against one another in parallel without spacing. The contact part 12 is pointed at the front according to the prior stamping.

As mentioned, the guide part 14 is box-shaped in design and possesses a cross-section of an equilateral triangle with the tip of the triangle in the original plane of he strip and with the base opposite. The sides issuing from the tip of the triangle enclose an angle of about 120°, whereas an angle of about 30° is enclosed between the sides in each case and the base. As shown in FIG. 1, the pin-shaped contact tip and the guide part have a common bending line which considerably simplifies the production process for the plug-in contact.

As already mentioned, the connecting part 16 is configured in a known manner as a crimp connection with a conductor connection 16.1 and an insulating connection 16.2. The conductor connection 16.1 interacts with the bare conductor wire which is clamped and therefore contacted here, whereas, in the insulating connection 16.2, the insulated conductor is surrounded and clamped in the insulated region.

A further example of a plug-in contact according to the invention is shown in various views in FIGS. 4*a* to 4*d*. The known reference numerals again represent the above-described parts. In contrast to the above-described embodiment, the first and second tongues 26, 27 are absent from the plug-in contact according to FIGS. 4*a* to 4*d* (cf., in particular, FIG. 1).

Figure 4A:
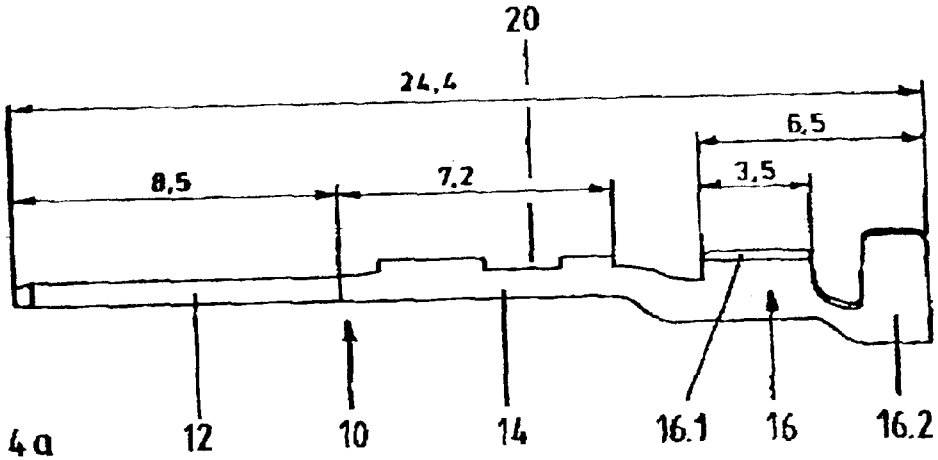
FIGS. 4*a* to 4*d* are various views of a further embodiment of a plug-in contact.
Figure 4B:
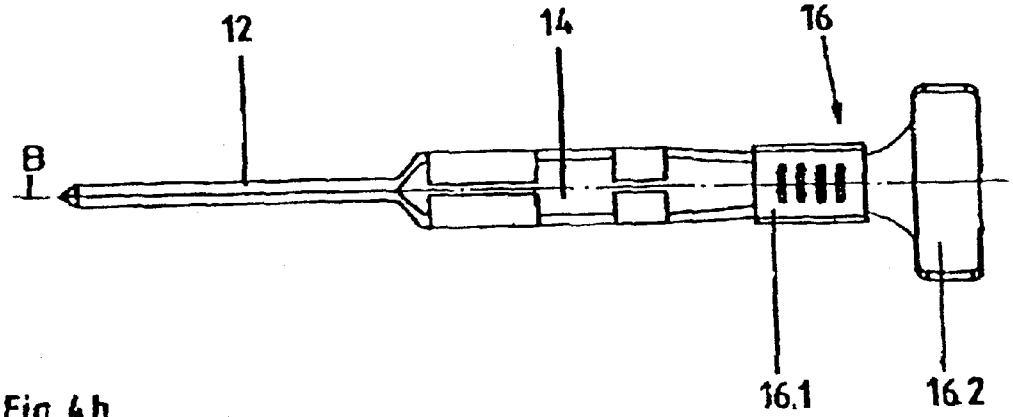
Figure 4C:
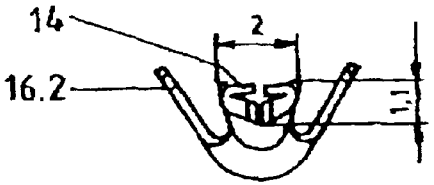
Figure 4D:
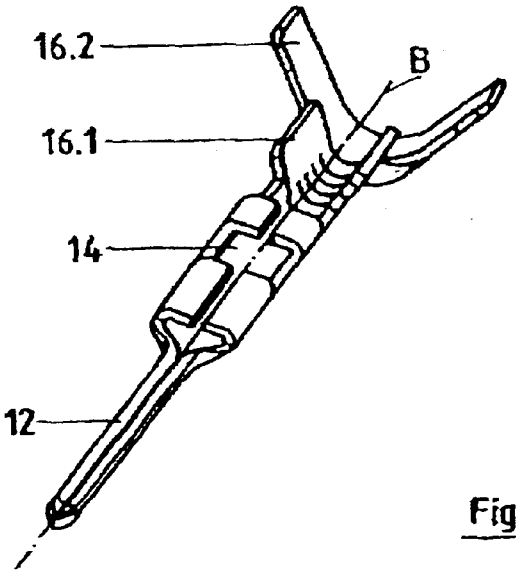

The dimensional details in FIG. 4*a* show the possible size of the plug-in contact. For example, it can have a length of 24.4 mm. The perspective view in FIG. 4*d* shows the common bending line B through the plug-in contact and the at least approximately triangular cross-sectional shape of the guide part 14.

What is claimed is:

1. A one-piece plug-in contact produced form a metal strip, comprising:

a pin-shaped contact part;

a connecting part for connecting an electric line to the plug-in contact;

a guide part between said contact part and said connecting part;

wherein said contact pat, said guide part, and said connecting part are integrally formed in one piece from a metal strip defining an original plane, and said guide part has a box having a triangular cross section with a flat side disposed at a distance from and parallel to the original plane.

2. The plug-in contact according to claim 1, wherein said guide part is formed by two lugs each angled at a first angle along a center line defined by the metal strip, said lugs are bent symmetrically towards one another at a second angle and having mutually abutting longitudinal edges, and said lugs form a covering face along said flat side.

3. The plug-in contact according to claim 2, wherein said first angle is between 60° and 120° and said second angle is between 30° and 60°.

4. The plug-in contact according to claim 2, wherein said first angle is substantially 120° and said second angle is substantially 30°.

5. The plug-in contact according to claim 1, wherein said guide part has a connection side formed with two lug-shaped projections serving as stop lugs.

6. The plug-in contact according to claim 5, wherein said lug-shaped projections are offset form said box of said guide part.

7. The plug-in contact according to claim 1, wherein said guide part is formed with a one-sided recess opposite the original plane defined by the metal strip.

8. The plug-in contact according to claim 7, wherein said recess is formed substantially half way along said guide part and divides said guide part into a leading guide box and a trailing guide box.

9. The plug-in contact according to claim 7, wherein said recess is bordered by end faces, at least on the connecting side, formed by tongues projecting downwardly from said lugs forming the covering faces of said leading guide box and said trailing guide box.

10. The plug-in contact according to claim 1, wherein said pin-shaped contact part is formed of two first partial lugs having a substantially identical cross-sections and being bent along a bending line into a closed cross-section symmetrically to a longitudinal axis of the plug-in contact, the bending line continuing in a direction towards said guide part.

11. The plug-in contact according to claim 1, wherein an end face of the box pat facing said pin-shaped contact part is covered in a transition to said contact part by two second tongues that are roughly identical in cross-section.

12. The plug-in contact according to claim 10, wherein said first and second tongues form rails for aiding during an insertion thereof into a plug housing.

13. The plug-in contact according to claim 8, wherein a front edge, facing said recess, of said leading box part adjacent said contact part serves as a stop edge for interlocking with a plug housing.

14. A plug assembly, comprising: a plug housing made of insulating material and at least one plug-in contact according to claim 1 disposed in said plug housing.

15. The plug assembly according to claim 14, wherein said at least one plug-in contact is held in force-lock and in form-lock in said plug housing.

16. The plug assembly according to claim 14, wherein said at least one plug-in contact is interlocked in said plug housing.

17. The plug assembly according to claims 14, wherein said plug housing is formed with at lest one catch projection interacting with said plug-in contact.

18. The plug assembly according to claim 14, wherein said plug-in contact is one of a plurality of plug-in contacts disposed in said plug housing.

19. The plug assembly according to claim 14, wherein said plug housing is a pine connector housing adapted to receive a plurality of plug-in contacts arranged side by side.

* * * * *